United States Patent [19]

Gallatin et al.

[11] 4,006,322

[45] Feb. 1, 1977

[54] AUXILIARY INTERLOCK SWITCH WITH INTERCHANGEABLE AND REVERSIBLE CHISEL-SHAPED CONTACTS AND SPRING BIASING MECHANISM

[75] Inventors: Paul M. Gallatin, Brookfield; Edward A. Halbach, Milwaukee, both of Wis.

[73] Assignee: Allis-Chalmers Corporation, Milwaukee, Wis.

[22] Filed: Sept. 22, 1975

[21] Appl. No.: 615,688

[52] U.S. Cl. ..... 200/16 A; 200/241; 200/243; 200/275; 200/280; 200/303; 335/132; 335/198

[51] Int. Cl.[2] ..... H01H 15/00; H01H 1/12; H01H 45/00

[58] Field of Search ..... 200/16 A, 76, 165, 242, 200/243, 245–247, 249–251, 280, 281, 303, 275; 335/135, 160, 126, 132, 133, 197, 198

[56] References Cited

UNITED STATES PATENTS

| | | | |
|---|---|---|---|
| 2,756,291 | 7/1956 | Peter | 200/280 X |
| 2,924,685 | 2/1960 | Burch | 200/243 X |
| 3,253,092 | 5/1966 | Landow | 200/280 X |
| 3,272,949 | 9/1966 | Lawrence | 200/275 X |
| 3,320,392 | 5/1967 | Mullen et al. | 200/243 |
| 3,324,270 | 6/1967 | Lacan | 200/275 X |
| 3,544,929 | 12/1970 | DiMarco et al. | 335/126 |

*Primary Examiner*—James R. Scott
*Attorney, Agent, or Firm*—Lee H. Kaiser

[57] ABSTRACT

An auxiliary interlock switch for a DC contactor has a reciprocable one-piece insulating contact carrier and plural bridging contacts interchangeably mounted thereon in alternative positions to provide different desired arrangements of normally open and normally closed contact sets with the stationary contact posts. The contact carrier has a return spring compressed within a spring-receiving cavity and elongated abutment-receiving apertures registering with opposite ends of said cavity through which an abutment member, that is releasably assembled to the contact carrier, may interchangeably freely extend to permit relative movement therebetween and against which one end of the return spring reacts to resiliently bias the contact carrier against reciprocation in one direction. The bridging contacts may be easily removed in the field and reassembled in desired contact configuration and are of resilient metal with bifurcated ends having "chisel" surfaces which provide high unit area contact pressure and plural points of engagement with each stationary contact post to thereby increase electrical reliability.

17 Claims, 12 Drawing Figures

AUXILIARY INTERLOCK SWITCH WITH INTERCHANGEABLE AND REVERSIBLE CHISEL-SHAPED CONTACTS AND SPRING BIASING MECHANISM

This invention relates to electromagnetic circuit makers and breakers of the contactor type and in particular to auxiliary interlock switches for DC contactors.

BACKGROUND OF THE INVENTION

Contactors are often provided with an auxiliary interlock switch which has a plurality of sets of electrical contacts for controlling auxiliary circuits such as the operating coils of auxiliary devices.

Known auxiliary interlock switches are constructed from a large number of separate pieces which require special fixtures and jigs to hold the pieces together during assembly, make change of contact arrangement in the field virtually impossible, and substantially increase both the number of machining and handling operations as well as the cost of the unit. Further, the electrical reliability of known auxiliary interlock switches is relatively low in that contamination of the contacts often prevent completion of a low voltage auxiliary circuit even though the contacts of the interlock are operated into engagement by the electromagnetic contactor.

OBJECTS OF THE INVENTION

It is an object of the invention to provide an improved auxiliary interlock switch for a contactor which obviates the above disadvantages of prior art devices and has substantially fewer parts than known interlocks. It is a further object of the invention to provide such an improved auxiliary interlock switch which does not require special fixtures and jigs to assemble the parts and wherein the movable contacts are easily assembled on the contact carrier and can be facilely changed in the field to provide any desired arrangement of contact sets. Another object of the invention is to provide such an improved auxiliary interlock switch which is less expensive than known devices and requires fewer machining and handling operations to construct.

A still further object of the invention is to provide such an improved auxiliary interlock switch which can easily be converted so that its reciprocable contact carrier is alternatively resiliently biased by the return spring to either a central position or to extreme positions in either direction from the central position. Still another object is to provide such an improved interlock switch for a contactor which, in comparison to prior art auxliary interlocks, has higher unit contact pressure and substantially improved electrical reliability.

SUMMARY OF THE INVENTION

An auxiliary interlock switch embodying the invention has increased electrical reliability in comparison to known devices and permits easy change of the auxiliary contact arrangement in the field. A reciprocable, one-piece insulating contact carrier is provided with a cavity in which a helical return spring is captive and first and second abutment-receiving apertures which register with opposite ends of the spring-receiving cavity and in which an abutment member may interchangeably be positioned with its ends affixed to opposed sidewalls of interlock housing so that the return spring reacts against the abutment member and biases the carrier toward reciprocation in a desired direction. The contact carrier also has a plurality of contact-receiving apertures in each of which a metallic bridging contact of generally U-shaped cross section with diverging ends is held captive by a loaded compression spring with the cross-piece of the U-shaped contact abutting against one end of the contact-receiving aperture. The bridging contacts may be easily removed in the field from the contact-receiving apertures and reversed in direction to provide normally open or normally closed sets of auxiliary contacts with the stationary contact posts, or may alternatively be disposed against the opposite end of the contact-receiving aperture in order to provide different arrangements of normally open and normally closed auxiliary contact sets, as desired. The bridging contacts are of resilient material and the legs thereof are bifurcated and have "chisel" shape surfaces which provide plural points of high unit area pressure arrangement with unitary stationary contact posts affixed to the interlock housing and substantially increase electrical reliability.

DESCRIPTION OF THE DRAWINGS

These and other objects and advantages of the invention will be more readily apparent from the following detailed description when considered in conjunction with the accompanying drawing wherein.

DETAILED DESCRIPTION

Figure 1:
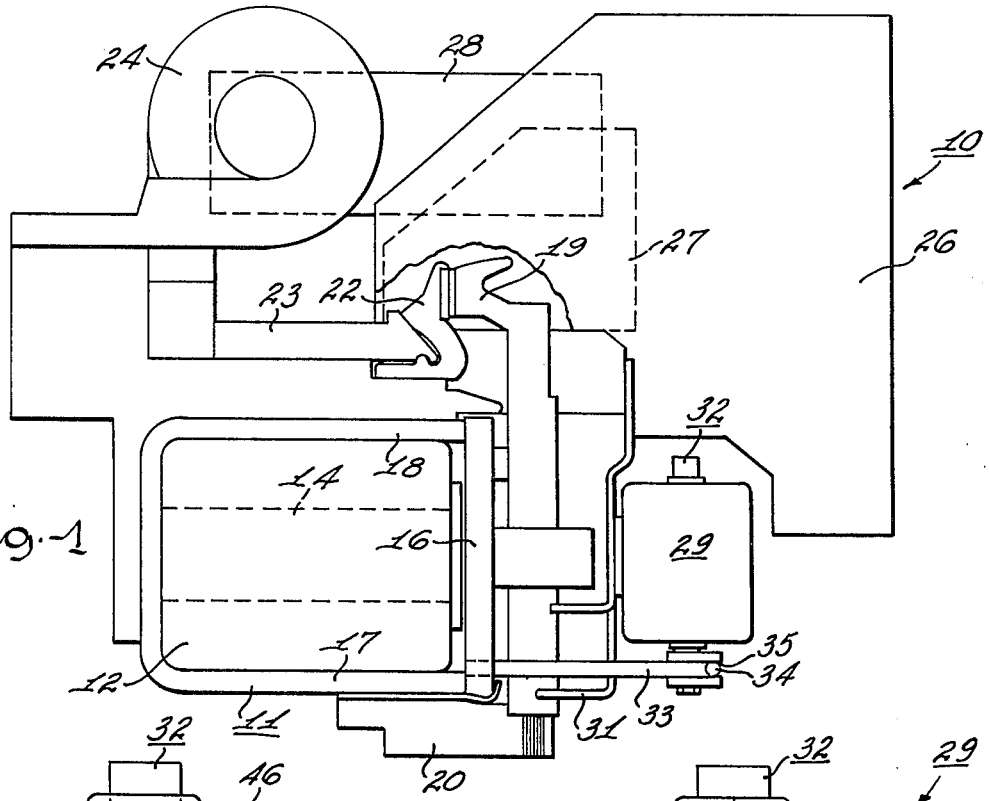
FIG. 1 is a front view of a known contactor provided with the improved auxiliary interlock switch of the invention.
Figure 2:
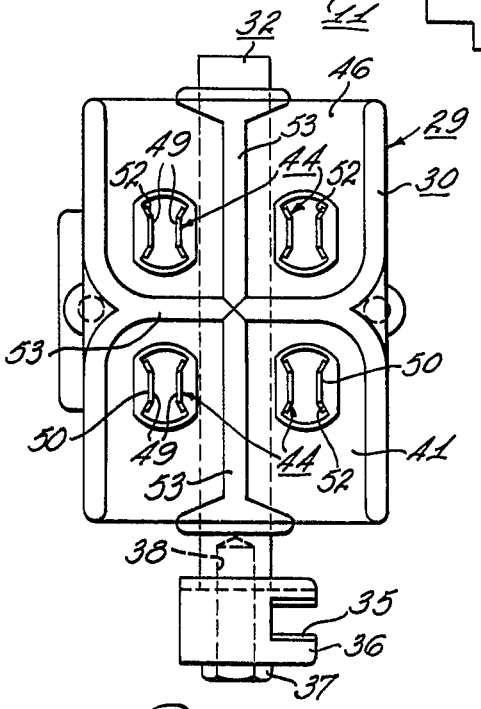
FIGS. 2, 3 and 4 are left side, front and bottom views respectively of the housing of the auxiliary interlock switch embodying the invention shown in FIG. 1.

Referring to FIG.1 of the drawing, a known contactor 10 may have a U-shaped ferromagnetic frame 11 which embraces a cylindrical operating coil 12 wound in surrounding relation to a ferromagnetic core 14 extending axially of coil 12. A ferromagnetic armature 16 pivotally connected to one leg 17 of frame 11 is pulled against the other leg 18 of the frame to operate the contactor when coil 12 is energized. The contactor movable main contact 19 is carried by armature 16 and may be electrically connected by a flexible lead (not shown) to a terminal block 20 and is adapted to engage a main stationary contact 22 when armature 16 is attracted to core 14. Stationary contact 22 is electrically connected to one end of a metallic bus bar 23 which at its opposite end is connected to a helical electrical blowout coil 24. The arc, which is formed when contacts 19 and 22 separate, transfers to and is interrupted in an arc chute 26 having pole pieces 27 (only one of which is shown) between which the magnetic field generated by blowout coil 24 extends. Only one of the flux carrying members 28 is shown which transfer the magnetic flux from blowout coil 24 to pole pieces 27.

The auxiliary interlock switch 29 for controlling auxiliary circuits includes an insulating housing 30 mounted on a support bracket 31 and is actuated by reciprocation of a elongated operating member, or contact carrier 32 slidably mounted within housing 30. The ends of a U-shaped interlock actuating member 33 are secured to armature 16, and the cross-piece 34 of member 33 actuates contact carrier 32 longitudinally to operate the interlock switch 29 when armature 16 is attracted to frame 11. Cross-piece 34 may fit within an elongated groove 35 provided in a member 36 attached to one end of contact carrier 32 by a bolt 37 secured within a threaded hole 38 in contact carrier 32.

Auxiliary interlock 29 is shown having four different contact sets which may alternatively be in different arrangements of normally open (make) and normally closed (break) and make-before-break contacts as desired as described hereinafter. The auxiliary interlock contacts may be interposed in the control circuit of contactor 10 or in the control circuit of a related controller and generally perform an interlocking function to assure a desired sequence of contactor operation.

Figure 3:
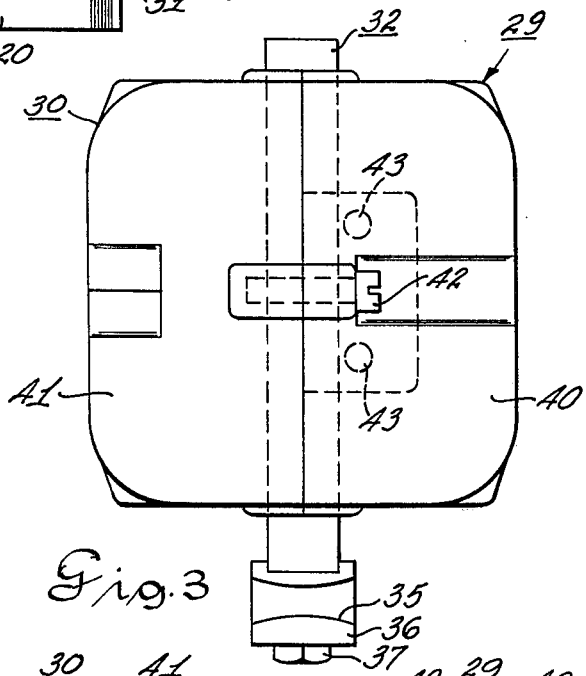
Figure 4:
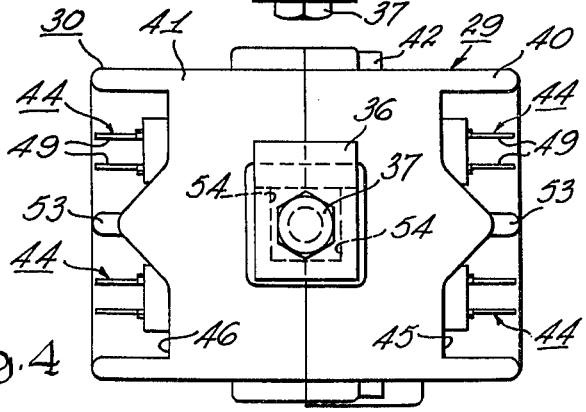
Figure 5:
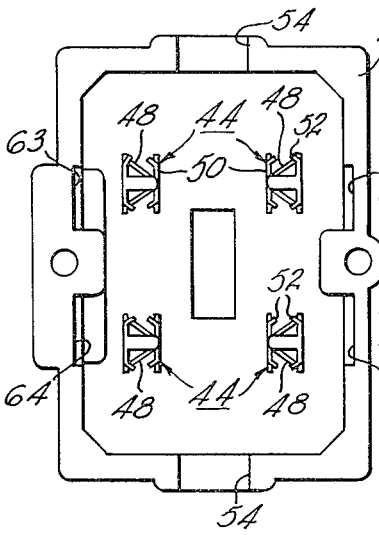
FIG. 5 is a view of the open end of the right half of the interlock switch housing shown in FIGS. 2–4 with the left housing half, contact carrier, and abutment member removed.

Interlock housing 30 is hollow and generally boxlike in shape and comprises similar right and left halves 40 and 41 respectively mated at their open ends and preferably molded of suitable insulating material such as a thermosetting phenolic compound. Right and left housing halves 40 and 41 may be held together by screws 42 (see FIG. 3) which extend through clearance apertures adjacent sidewalls of right housing half 40 and engage threaded metallic inserts (not shown) molded in left housing half 41. Interlock housing 30 may be mounted on bracket 31 by screws (not shown) which are secured within threaded inserts 43 molded in housing half 40.

Four metallic stationary contact posts 44 project from a wall 45 of right housing half 40 into the interior of the housing 30 and also extend exterior of the housing, and four similar metallic stationary contact posts 44 project from a wall 46 of left housing half 41 into the interior of housing 30 and also extend exterior of the housing. Each contact post 44 has a portion 48 of generally triangular cross section disposed within housing 30 which is unitary with two spaced, parallel, flat terminal portions 49 that protrude through parallel spaced openings 50 molded in wall 45 of housing half 40, or in wall 46 of housing half 41. Stationary contact posts 44 may be secured to wall 45 or wall 46 by bending over protruding edges of terminal portions 49 such as shown by reference numeral 52, both interior and exterior of housing 30. The spaced terminal portions 49 of each stationary contact post 44 form a two-prong male connector which may accept a complementary female connector. Barrier walls 53 molded on the exterior of right housing half 40 and on the exterior of left housing half 41 separate adjacent stationary contact posts 44 to provide high electrical breakdown strength between auxiliary circuits. The stationary contact posts 44 are preferably fabricated of metal such as brass with an overlay of silver upon triangular portion 48 to minimize resistance with the bridging contacts 71 carried by operating member 32.

Housing halves 40 and 41 have U-shaped apertures 54 in the end walls thereof which face each other to define openings of rectangular cross-section (when halves 40 and cover 41 are mated) in which contact carrier 32 slidably reciprocates longitudinally of housing 30. In contrast to contact carriers of prior art interlocks which were constructed of plural insulating pieces held together by bolt means, contact carrier 32 is preferably molded in one piece from suitable insulating material. Contact carrier 32 has an elongated spring-receiving cavity 55 (see FIGS. 8, 9 and 10) extending laterally therethrough intermediate its ends and in a plane parallel to its longitudinal axis in which a helical return spring 56 is compressed and held captive so that the ends of return spring 56 react against the walls of contact carrier 32 defining cavity 55. Elongated ridges 57 (see FIG. 8) are preferably provided on contact carrier 32 along one edge of spring-receiving cavity 55 to prevent removal of spring 56 through one side of cavity 55, and projections 58 (see FIG. 9) are preferably provided along the opposite edges of cavity 55 to block lateral movement of the ends of spring 56, thus tending to hold return spring 56 captive within cavity 55.

Figure 7:
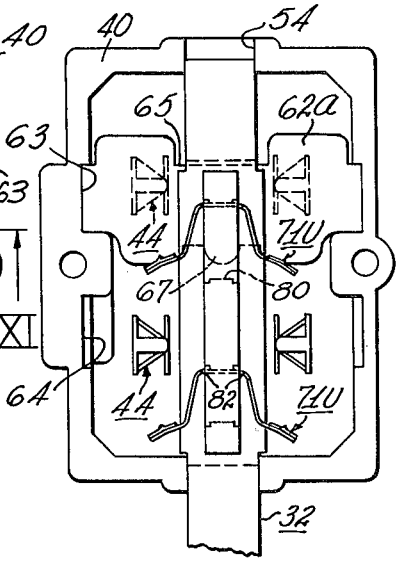
FIG. 7 is a view similar to FIG. 6 having the contact carrier assembled with an end abutment member which biases the contact carrier to an extreme position in one direction.
Figure 10:
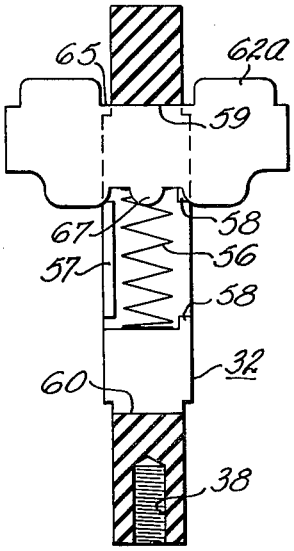
FIG. 10 is a section view through the reciprocable contact carrier removed from the housing and assembled with an end abutment member.

Elongated abutment-receiving apertures 59 and 60 (see FIG. 8) extend laterally through contact carrier 32 in the plane of its longitudinal axis and which register with the ends of spring-receiving cavity 55. An end abutment member 62*a* of suitable insulating material such as polyester resin bonded glass mat may be interchangeably assembled within abutment-receiving aperture 59, as shown in FIGS. 7 and 10, so that contact carrier 32 is resiliently normally biased downward and is operated in the upward direction against the force of return spring 56, or end abutment member 62*a* may alternatively be assembled within abutment-receiving aperture 60 (in a position not shown) so that contact carrier 32 would be normally biased upward (relative to the position shown in the drawing) and would be operated downward against the force of return spring 56. When end abutment member 62*a* is assembled within aperture 59, its ends fit within elongated grooves 63 molded in opposed sidewalls of housing half 40 and which grooves face similar grooves 63 molded in opposed sidewalls of housing half 41, thereby holding end abutment member 62*a* from movement relative to housing 30. End abutment member 62*a* has a notch 65 intermediate its ends in one sidewall thereof which embraces contact carrier 32 and has a projection 67 in the opposite sidewall thereof intermediate its ends which protrudes into the axial opening in helical return spring 56, thereby normally positioning contact carrier 32 relative to end abutment member 62*a* by the force of compressed return spring 56. It will be appreciated that when end abutment member 62*a* is disposed within abutment-receiving aperture 59, contact carrier 32 is normally biased toward downward movement as shown in FIG. 7 and that reciprocation of contact carrier 32 upward to operate the interlock switch will further compress return spring 56 against end abutment member 62*a*, which slides within abutment-receiving aperture 59, to further load return spring 56. End abutment member 62*a* may be easily disassembled from contact carrier 32 by manually compressing return spring 56 and withdrawing end abutment member 62*a* in a longitudinal direction from abutment-receiving aperture 59, and end abutment member 62*a* may then be turned over and assembled through abutment-receiving aperture 60 at the lower end of return spring 56, in which position its ends fit within elongated grooves 64 molded in opposed sidewalls of housing half 40 and which grooves 64 face similar grooves 64 molded in the sidewall of housing half 41, thereby preventing movement of end abutment member 62*a* relative to housing 30. It will be appreciated that when end abutment member 62*a* is assembled within abutment receiving aperture 60, contact carrier 37 is normally biased against downward movement and that reciprocation of contact carrier 32 downward to operate the interlock will further compress return spring 56 against end abutment 62*a* and increase the force tending to return contact carrier 32 to its initial position.

Figure 6:
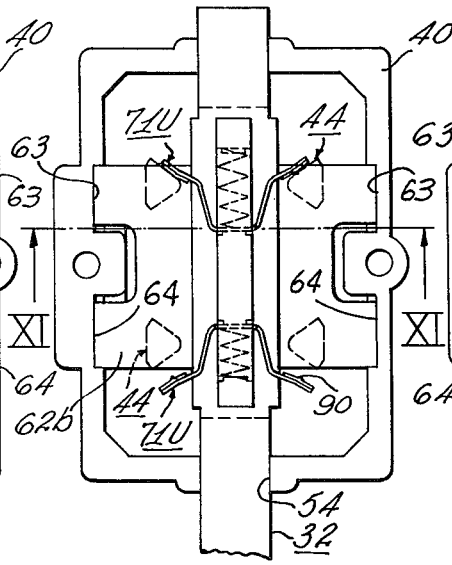
FIG. 6 is a view similar to FIG. 5 but having the right housing half assembled with the contact carrier and a centering abutment member which biases the contact to a central position within the housing.
Figure 8:
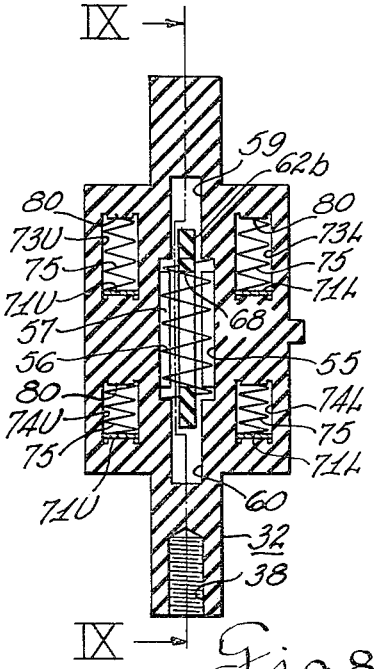
FIG. 8 is a right side view of the reciprocable contact carrier removed from the housing and assembled with a centering abutment member.
Figure 9:
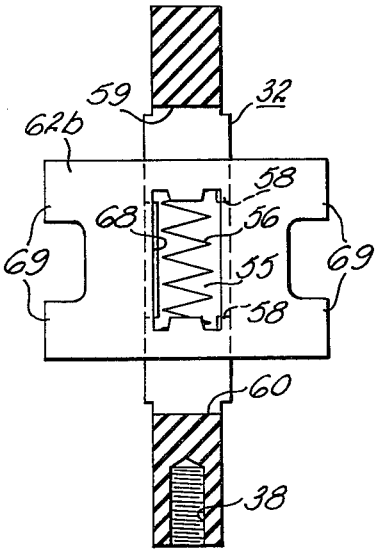
FIG. 9 is a sectional view taken along line IX—IX of FIG. 8.

Contact carrier 32 may alternatively be normally held in a central position within housing 30 wherein it is biased against reciprocation in either directon when a centering abutment member 62*b* having a central rectangular cavity 68 which embraces helical return spring 56 is substituted for end abutment member 62*a* and is assembled to be slidable within both abutment-receiving apertures 59 and 60 (see FIGS. 6, 8 and 9). Each end of centering abutment member 62*b* has a pair of spaced projections 69 which fit within grooves 63 and 64 in the sidewalls in housing halves 40 and 41 to prevent movement of centering abutment member 62*b* relative to housing 30. Opposite ends of return spring 56 react against the ends of rectangular cavity 68 in stationary centering abutment member 62*b* and also react against the ends of spring-receiving cavity 55 in contact carrier 32, and consequently return spring 56 is further compressed when contact carrier 32 is reciprocated in either direction from its normal central position so that centering abutment member 62*b* slides within abutment-receiving aperture 59 or 60.

Figure 11:
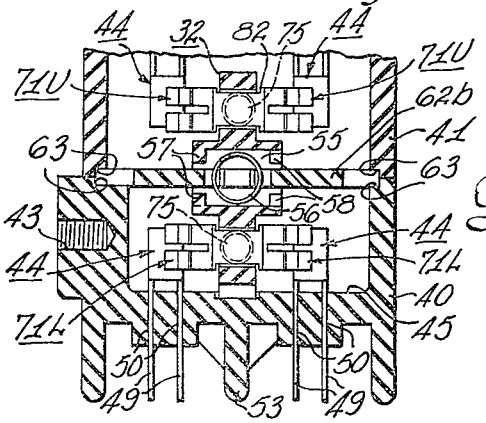
FIG. 11 is a partial vertical section view taken through the auxiliary interlock switch along line XI—XI of FIG. 6.
Figure 12:
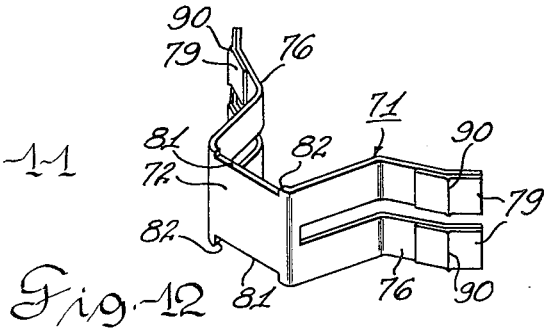
FIG. 12 is a perspective view of one of the bridging contacts.

Contact carrier 32 carries two bridging metallic contacts 71L (see FIGS. 8 and 11) which engage and disengage the stationary contact posts 44 projecting inwardly from wall 45 of housing half 40 and also carries two bridging metallic contacts 71U which engage the stationary contact posts 44 extending inwardly from wall 46 of housing half 41. Each bridging contact 71 is generally of U-shape cross-section in a plane perpendicular to stationary posts 44, and the ends 76 of each leg diverge at an oblique angle to permit engagement with opposed faces of the triangular cross-section portion 48 of a stationary contact post 44. Each leg of bridging contact 71 is bifurcated (see FIG. 12) so that each bridging contact 71 has plural points of engagement with the corresponding stationary contact posts 44, thereby assuring that a particle of dust cannot prevent completion of a low voltage auxiliary circuit controlled thereby, and also substantially increasing the electrical reliability of the interlock in comparison to prior art devices which utilized button contacts. Each bridging contact 71 is preferably constructed of beryllium copper and the diverging ends 76 thereof preferably have an overlay 79 of high conductivity metal such as silver and have "chisel shape" surfaces 90 to assure high contact pressure per unit area and to facilitate wiping motion with a stationary contact post 44.

Contact carrier 32 has a pair of contact-receiving openings 73U and 74U (see FIG. 8) extending laterally there-through within housing half 41 and also has a similar pair of contact receiving openings 73L and 74L extending laterally there-through within housing half 40. Contact-receiving openings 73 and 74 are of rectangular cross-section and permit a bridging contact 71 (See FIG. 12) to be inserted longitudinally there-through and then turned so that the cross-piece 72 of the U-shaped bridging contact 71 abuts against one end wall of contact-receiving opening 73 or 74. A helical contact spring 75 loaded between the opposite end wall of each contact-receiving opening 73 or 74 and the cross-piece 72 holds the bridging contact 71 captive on contact carrier 32. Each U-shape bridging contact 71 may be interchangeably assembled on contact carrier 32 in a first position wherein its open end faces in one direction (for example, upward as shown by the normally closed "break" contacts in FIG. 6) so that its diverging ends 76 engage and disengage the upper face of the triangular stationary contact portions 48 as contact carrier 32 reciprocates, or in a second position wherein its open end faces in the opposite direction (for example, downward as shown by the normally open "make" contacts in FIGS. 6 and 7) so that its diverging ends 76 engage and disengage the lower face of the triangular stationary contact portion 48. The cross-piece 72 of each bridging contact 71 may be positioned against either end of the contact-receiving aperture 73 or 74. It will thus be appreciated that bridging contacts 71 may be assembled in any desired arrangement of normally open and normally closed contact sets with the stationary contact posts 44. Such arrangement of auxiliary circuit contacts may be easily changed in the field by merely pushing any bridging contact 71, which it is desired to change, out from its contact-receiving opening 73 or 74 and reversing said bridging contact 71 so that it faces the opposite direction, or so that its cross-piece 72 abuts the opposite end of the contact-receiving aperture 73 or 74. In contrast, the contact carriers of prior art interlocks and the movable contacts carried thereby were assembled from a multiplicity of pieces and required special jigs and fixtures to hold the components in place during construction of the contact carrier assembly, thereby permitting fabrication of such prior art devices only at the factory where the fixtures were available and virtually preventing change of interlock contact arrangement in the field.

Contact-receiving opening 73 is preferably longer than contact-receiving opening 74, (see FIG. 8) thereby permitting make-before-break contacts and also permitting opening and closing of the auxiliary circuits after different lengths of travel of contact carrier 32. A normally open bridging contact 71 disposed in the longer contact-receiving opening 73 can move further within spring-receiving opening 73 after initial engagement with its associated stationary contact posts 44 upon overtravel of contact carrier 32 than is possible for a bridging contact 71 disposed in shorter opening 74, and this structure also permits a bridging contact 71 within longer opening 73 to remain engaged with said posts 44 under force of its helical contact spring 75 for a longer time than a bridging contact 71 within shorter opening 74 when the operating member 32 reciprocates in the opposite direction.

The walls of contact carrier 32 defining the ends of contact-receiving openings 73 and 74 have projections 80 which fit into the axial openings in helical springs 75 and tend to hold springs 75 captive. The height of each bridging contact 71 is greater than that of contact-receiving opening 73 or 74, but the cross-piece 72 of each bridging contact 71 has an indentation 81 (see FIG. 12) so that bridging contact 71 can be assembled longitudinally through an opening 73 or 74 and then turned so that cross-piece 72 abuts one end of the opening and the edges 82 of indentation 81 overlap the contact carrier walls and limit lateral movement of the bridging contact 71 relative to carrier 32.

While only a single embodiment of the invention has been illustrated and described, it should be understood that we do not intend to be limited to the single embodiment for many modifications and variations thereof will be obvious to those skilled in the art.

The embodiments of the invention in which an exclusive property or privilege is claimed are defined as follows:

1. An electrical circuit making and breaking interlock switch comprising, in combination, a hollow insulating housing having at least two pair of stationary contact posts projecting inwardly from a wall thereof, an insulating contact carrier mounted for reciprocation through said housing and being accessible from the housing exterior, said contact carrier having a spring-receiving cavity therein and elongated first and second abutment-receiving apertures extending therethrough which register with opposite ends of said spring-receiving cavity, an abutment member adapted to be releasably assembled to said contact carrier and extend freely through one of said abutment-receiving apertures so that said contact carrier is movable relative thereto and having its ends in engagement with opposed walls of said housing to prevent movement thereof as said contact carrier reciprocates, a helical return spring compressed within said spring-receiving cavity and reacting at one end against said abutment member assembled within said one abutment-receiving aperture to normally resiliently bias said contact carrier against reciprocation in one direction, and a pair of unitary metallic bridging contacts carried by said contact carrier each of which is adapted to engage and bridge between the stationary contact posts of one of said pairs as said contact carrier reciprocates in one direction and to disengage them as said contact carrier reciprocates in the opposite direction.

2. An interlock switch in accordance with claim 1 wherein said abutment member extends into and slides within both said abutment-receiving apertures and also has a spring-receiving opening therein which embraces and holds captive said helical return spring so that both ends of said return spring react against said abutment member and resiliently bias said contact carrier against movement in either direction from a central position within said housing.

3. An interlock switch in accordance with claim 1 wherein said contact carrier also has a pair of elongated contact-receiving openings extending laterally therethrough and each said bridging contact protrudes through one of said contact-receiving openings and is held captive against one end of said opening by a compression spring loaded between it and the other end of said contact-receiving opening, said bridging contact being adapted to be interchangeably held captive within said contact-receiving opening by said compression spring in a first position wherein it engages one side of a pair of said stationary contact posts or to be reversed and held captive by said compression spring within said opening in a second position wherein it is adapted to engage the opposite side of said pair of stationary contact posts.

4. An interlock switch in accordance with claim 3 wherein said pair of contact-receiving openings are spaced apart longitudinally of said contact carrier and each of said bridging contacts is generally of U-shape cross section in a plane perpendicular to said stationary contact posts with the legs thereof diverging at an oblique angle, said U-shaped bridging contacts being adapted to be alternatively assembled within said contact-receiving openings in said first and second positions wherein the open ends thereof face in opposite directions and engages opposite sides of a pair of said stationary contact posts.

5. An interlock switch in accordance with claim 4 wherein each leg of said U-shape bridging contacts is bifurcated to provide plural points of engagement with a stationary contact post.

6. An interlock switch in accordance with claim 5 wherein said bridging contacts are of resilient metal and the bifuracted ends of said diverging legs have chisel-shape surfaces which provide high contact pressure per unit area with said stationary contact posts.

7. An interlock switch in accordance with claim 6 wherein each of said stationary contact posts is one-piece and protrudes through said wall of said housing, the portion of each said stationary contact post interior of said housing being of generally V-shaped cross-section so that said diverging ends of said bridging contact may engage either side of said stationary contact post with a wiping action.

8. An interlock switch in accordance with claim 7 wherein each of said U-shaped bridging contacts is adapted to be interchangeably held by a compression spring within said contact-receiving opening with the cross-piece thereof abutting against said one end of said opening or against the opposite end of said opening.

9. An interlock switch in accordance with claim 3 wherein said housing has a plurality of pairs of first said stationary contact posts extending inwardly of said housing from a first wall thereof and a plurality of pairs of second said stationary contact posts extending inwardly of said housing from a second wall thereof opposite said first wall, and said contact carrier has a plurality of first said contact-receiving openings which receive said bridging contacts that engage said first stationary contact posts and a plurality of second contact-receiving openings which receive said bridging contacts that engage said second stationary contact posts.

10. An interlock switch in accordance with claim 9 wherein said return spring-receiving opening and said abutment receiving opening in said contact carrier are disposed in a common plane perpendicular to and disposed between said first and said second stationary contact posts and also disposed between said first and second contact-receiving openings in said contact carrier.

11. An interlock switch in accordance with claim 10 wherein said housing comprises two generally box-shaped halves with open sides facing each other, and at least one of said halves has grooves in the interior surface of opposing side walls thereof which receive the ends of said abutment member.

12. An interlock switch in accordance with claim 6 wherein one of said contact-receiving openings in said contact carrier is longer than the other so that one of said bridging contacts can engage or disengage its associated stationary contact posts before the other bridging contact engages or disengages its associated stationary contact posts.

13. An interlock switch in accordance with claim 1 wherein said contact carrier has a pair of contact-receiving openings extending laterally therethrough spaced apart longitudinally of said contact carrier, and each said bridging contact protrudes through one of said contact-receiving opening and is held captive against one end of said contact-receiving opening by a compression spring loaded between it and the other end of said contact-receiving opening, said bridging contact being adapted to be interchangeably held by said compression spring in a first position within said contact-receiving opening wherein it is adapted to engage one side of a pair of said stationary contact posts or to be reversed and held in said opening by said compression spring in a second position wherein it is adapted to engage the opposite side of said stationary contact posts.

14. An interlock switch in accordance with claim 13 wherein each of said bridging contacts is of generally U-shape cross-section in a plane perpendicular to said stationary contact posts and the legs thereof diverge at an oblique angle and are adapted to engage said stationary contacts posts, said legs of said U-shaped bridging members being bifurcated to provide plural points of engagement with said stationary contact posts.

15. An interlock switch in accordance with claim 14 wherein each of said stationary contact posts is one-piece and protrudes through said wall of said housing, the portion of said stationary contact posts interior of said housing being of generally V-shaped cross-section in a plane transverse to said posts so that said diverging ends of said bridging contact may engage either side of said stationary contact posts with a wiping action.

16. An interlock switch in accordance with claim 15 wherein said bridging contacts are of resilient metal and the ends of said bifurcated legs generally have chisel-shape engagement surfaces which provide high contact pressure per unit area with said stationary contact posts.

17. An interlock switch in accordance with claim 16 wherein each of said bridging contacts is adapted to be interchangeably held by said compression spring within said contact-receiving spring so that the cross-piece of said U-shaped bridging contacts abuts against either one end of said opening or against the opposite end of said opening.

* * * * *